United States Patent [19]

Gordbegli

[11] Patent Number: 4,595,825

[45] Date of Patent: Jun. 17, 1986

[54] THERMOSTATICALLY CONTROLLED ELECTRIC WATER HEATER

[75] Inventor: Manochehr Gordbegli, Santa Ana, Calif.

[73] Assignee: Purex Pool Products, Inc., Lakewood, Calif.

[21] Appl. No.: 621,791

[22] Filed: Jun. 18, 1984

[51] Int. Cl.[4] ..... H05B 1/02; F24H 1/10

[52] U.S. Cl. ..... 219/306; 126/351; 219/308; 219/328; 219/331

[58] Field of Search ..... 219/296–299, 219/302–309, 328, 331; 126/351

[56] References Cited

U.S. PATENT DOCUMENTS

| | | | |
|---|---|---|---|
| 383,536 | 5/1888 | Newman | 219/296 X |
| 1,375,357 | 4/1921 | Bosworth et al. | 219/296 |
| 1,532,903 | 4/1925 | Kercher | 219/314 X |
| 1,715,687 | 6/1929 | Vaughan | 219/306 |
| 1,731,058 | 10/1929 | Pierson | 219/305 X |
| 2,073,847 | 3/1937 | Miller | 219/306 X |
| 2,592,568 | 4/1952 | Hill | 219/328 |
| 4,185,187 | 1/1980 | Rogers | 219/306 |

*Primary Examiner*—A. Bartis

*Attorney, Agent, or Firm*—William W. Haefliger

[57] ABSTRACT

An electric water heater for heating a flow of pool or spa water includes an elongated metallic body of brass, bronze, aluminum or alloys thereof. A lengthwise elongated hollow in the body defines a water flow path having inlet and outlet openings directly communicating with the ends of the hollow. An electric resistance immersion heating element is positioned in the hollow between the inlet and outlet for heating a flow of water and is controlled by a heat sensing element, such as a thermostat, disposed in an opening in a thick body portion forming an elbow passage corner-turning the water flow path at one of the inlet and outlet openings. The thick body portion projects into the elbow passage and has a first face facing the opening and merging with a second face facing the elongated hollow at a convex locus extending widthwise across the elbow passage. The sensing element receiving opening extends widthwise of the convex locus. The thick body portion protects the sensing element from corrosion and erosion damage.

9 Claims, 6 Drawing Figures

13a
13
15
18
44
POOL OR SPA
10
11
17
17a
TO HEATING ELEMENT 17
33
CONTROL
32
2
2
31
FROM THERMO-STAT ~30~
PUMP
19
11a
ELECTRIC HEATING ELEMENT
THERMO-STAT
16
20c
~21~
12
12a
30
t
20b
3
3
20
23
23a
20a
14

10
23
14
23a
20c
20
11
20a
20b

THERMOSTATICALLY CONTROLLED ELECTRIC WATER HEATER

BACKGROUND OF THE INVENTION

This invention relates generally to pool, spa or other water heaters, and more particularly to the extension of the useful lives of such heaters and controls therefor.

In the past, thermostats enclosed in thin-walled copper sleeves were inserted into such heaters so that the water temperature was sensed, for controlling the heater. Such thin-walled sleeves tend to corrode and/or erode relatively rapidly, so that the water would leak to the outside of the heater vessel. This necessitated heater replacement or repair, which is expensive.

SUMMARY OF THE INVENTION

It is a major object of the invention to provide means to overcome the above problems, and thereby extend the useful lives of such heaters. Basically, the improved heater comprises:

(a) a hollow metallic body having inlet and outlet openings for flowing water therethrough, (b) means to heat the flowing water, (c) the body having an integral thick body portion past which water flows and in contact with said body portion, (d) an opening formed in said thick body portion, said opening being isolated from the flowing water, (e) and a heat sensing element in said opening and in heat transfer communication with the water flowing past said body portion.

As will appear, the heater body portion typically comprises a boss projecting in the path of the inflowing water and is positioned or angled for good water contact and heat transfer to the thermostat; and the body portion has a surface exposed to contact by said flowing water, the minimum thickness of said body portion between said surface and said opening being greater than 3/16 inch.

These and other objects and advantages of the invention, as well as the details of an illustrative embodiment, will be more fully understood from the following specification and drawings, in which:

DRAWING DESCRIPTION

FIG. 1 is an elevation taken in section through a heater embodying the invention.

FIG. 1*a* is a block diagram of a control system;

DETAILED DESCRIPTION

Figure 1:
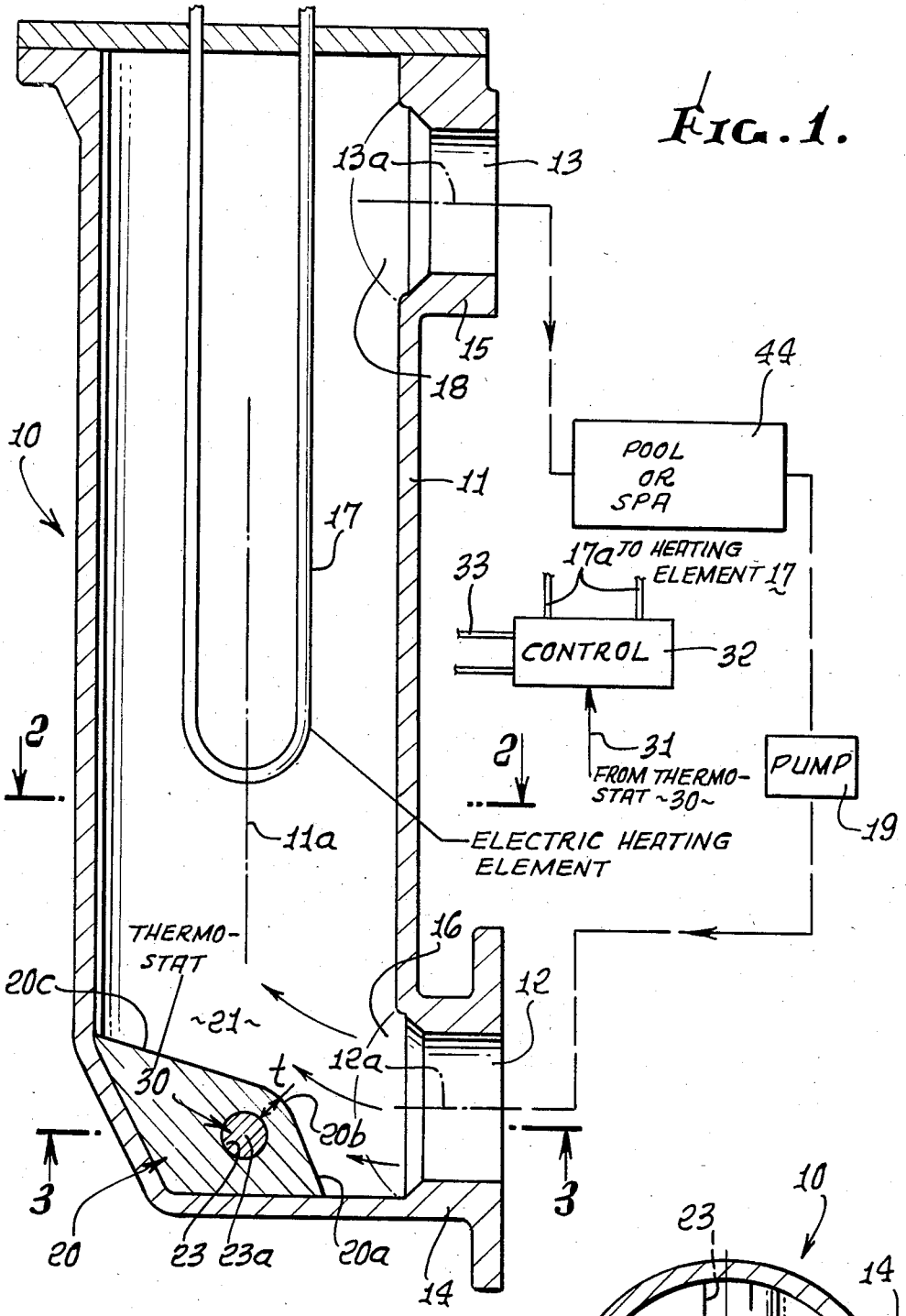
Figure 2:
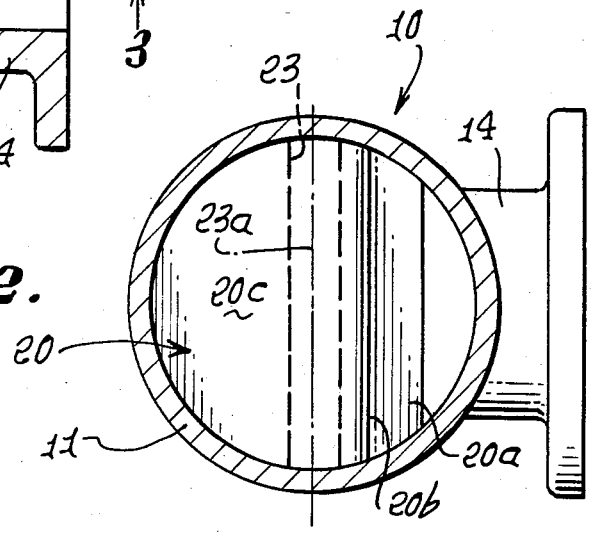
FIG. 2 is a section on lines 2—2 of FIG. 1.
Figure 1A:
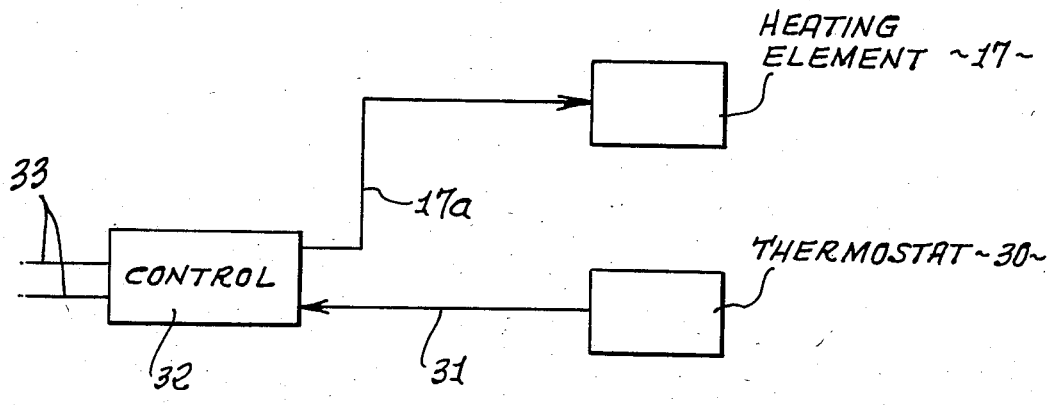
Figure 3:
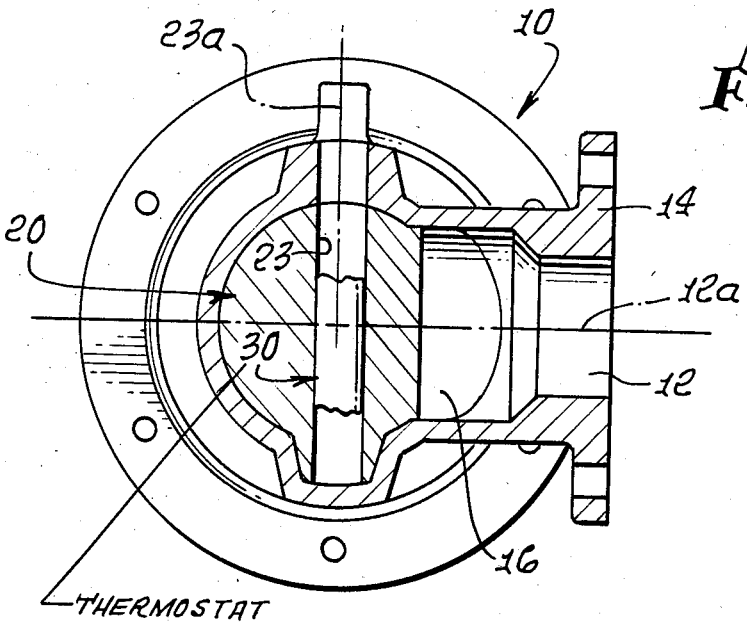
FIG. 3 is a section on lines 3—3 of FIG. 1.

In FIG. 1, a water heater 10 comprises a hollow tubular body 11 having inlet and outlet openings 12 and 13 formed by integral tubular bosses 14 and 15. The openings 12 and 13 have axes 12*a* and 13*a* normal to the elongates axis 11*a* of body 11. Water typically flows from source 44, as for example a pool or spa, and via pump 19 to inlet 12, is turned at elbow 16, and flows upwardly in body 11 in contact with electrical heating element 17. The heated water is turned at elbow 18, flows through the outlet 13, for return to the pool or spa 44.

The body 11 typically consists of heat conductive metal, such as cast brass, bronze, aluminum, or alloys of any of these. Other metals are also usable. The body 11 has an integral thick portion 20 such as a boss projecting in hollow 21, thereof and past which water flows and in good heat transfer contact with the exposed surfaces of the portion, as at 20*a*, 20*b*, and 20*c*. The latter are angled to deflect the inflowing water, to turn at the elbow region 16, as referred to. An elongated transverse opening is formed at 23 in the boss or portion 20, so that the axis 23*a* of opening 23 is generally normal to the direction of the inflowing water and parallel to the surfaces 20*a*, 20*b* and 20*c*. Thus, the metal thickness as at "t" between the opening and any selected portion of any of the surfaces 20*a*, 20*b* and 20*c* preferably remains substantially constant in a transverse direction, i.e., the direction of axis 23*a*.

A heat sensing element 30, as for example a thermostat, is inserted or located in opening 23, to be in direct heat transfer contact with the inner wall of the opening, whereby the element 30 quickly senses any changes in the inflowing water temperature due to good and direct heat transfer from surfaces 20*a*, 20*b* and 20*c* to the sensing element. The thermostat electrical output is transmitted at 31 to control 32, which in turn increases electrical current flow at 17*a* to heat element 17 if the incoming water temperature is too low, and vice versa. Supply current is provided at 33.

It will be noted that, due to the thickness "t" of the body portion 20 between opening 23 and surfaces 20*a*, 20*b* and 20*c*, the life of the heater is extended way beyond that of a heater employing a thin-walled metal sleeve about the thermostat and exposed to the water flow. Corrosion and erosion of such a thin-walled sleeve results in water contact with the thermostat and thereby reduces heater life to undesirable extent, such problems being eliminated by the present invention. Thickness "t" should exceed about 3/16 inch, as measured to the opening 23 from all locations along surfaces 20*a*, 20*b* and 20*c*.

Figure 4:
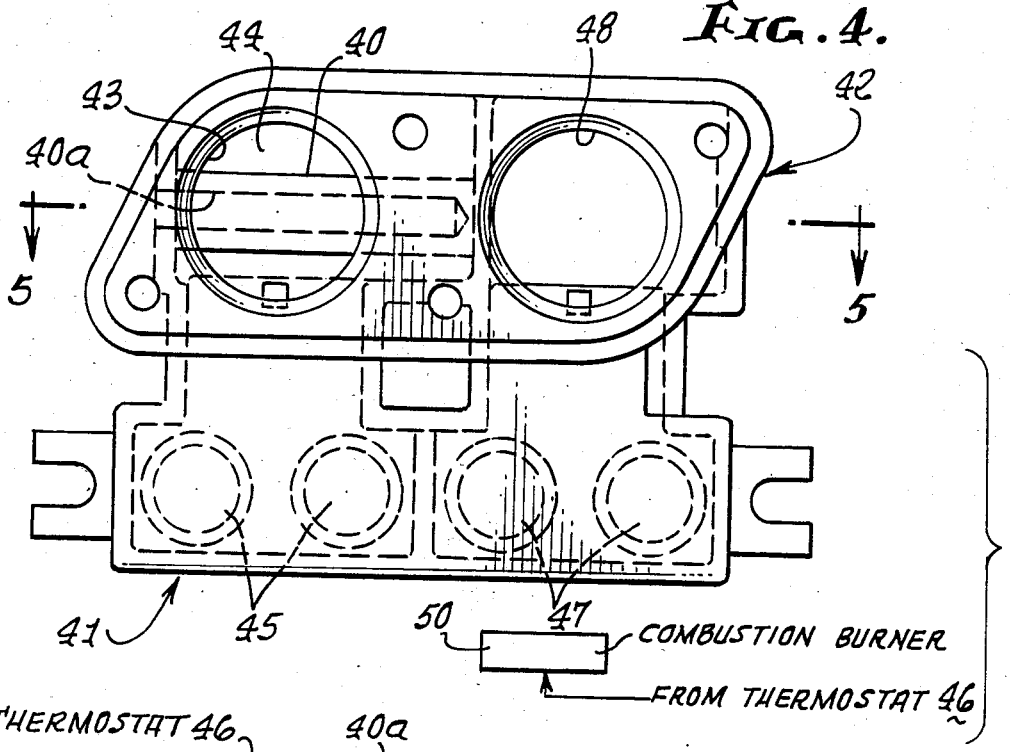
FIG. 4 is a view showing a header for a combustion type of water heater.
Figure 5:
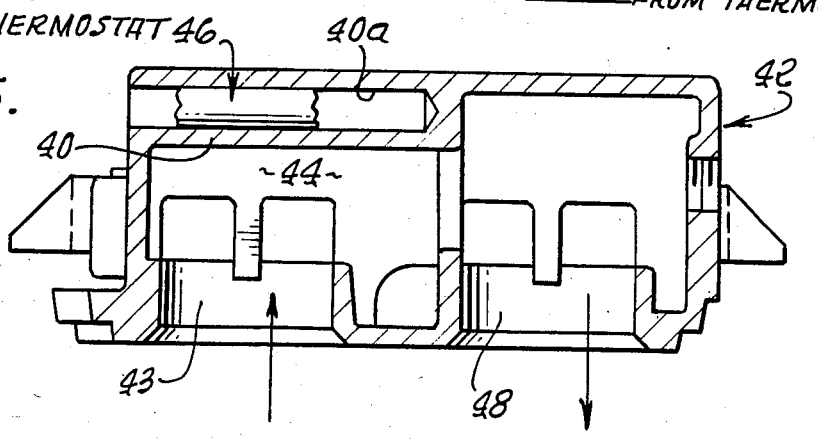
FIG. 5 is a section on lines 5—5 of FIG. 4.

FIGS. 4 and 5 shown similar thick boss or body portion 40 in a hollow header for combustion type water heater 41. The header body 42 has pool or spa water inlet 43, and elbow 44 to turn the water flow into ducts 45 that extend across the flame path or zone. Boss 40 is located at elbow 44, and contains a transverse opening 40*a* for receiving a thermostat 46 which controls fuel supply to the heater. Water flows back across the flame zone in ducts 47 and re-enters the header body 42 to exit at outlet 48 for flow to the pool or spa. A heater element such as a gas pipe is schematically shown at 50.

I claim:

1. A water heater, comprising (a) a metallic body having a lengthwise elongated hollow and inlet and outlet openings directly communicating with said hollow at spaced intervals therealong, for flowing water therethrough, (b) means to heat the flowing water, (c) the body having an integral thick body portion past which water flows and in contact with said body portion, (d) an opening formed in said thick body portion, said opening being isolated from the flowing water, (e) and a heat sensing element received in said opening in said body portion and in heat transfer communication with the water flowing past said body portion, (f) said body forming an elbow passage to corner-turn the water flow path proximate one of said inlet and outlet openings, said thick body portion projecting into said elbow passage at the location at which water flow corner-turns, the thick body portion having a first surface directly facing one of said inlet and outlet openings, and a second surface directly facing lengthwise of and toward the elongated hollow, said surfaces merging at a convex locus extending widthwise across said elbow, said heat sensing element receiving opening extending substantially parallel to the widthwise extent of said convex locus.

2. The heat of claim 1 wherein said body portion forms a boss projecting in the direct path of the in-flowing water proximate said inlet opening.

3. The heater of claim 2 wherein said first and second surfaces and their convex locus of merging extend across the full width of said elbow passage, whereby the cross section of the elbow passage decreases to a minimum at said locus of merging and then increases toward said hollow.

4. The heater of claim 1 wherein said body consists of material selected from the group that includes (a) brass (b) bronze (c) aluminum (d) alloys of any of (a), (b) or (c).

5. The heater of claim 1 wherein said heating means comprises an electrical heating element projecting in said body.

6. The heater of claim 1 including control means connected with said sensing element and with said heating means to effect increased heating of the water in response to a predetermined drop in water temperature sensed by said sensing element.

7. The heater of claim 1 wherein the minimum thickness of said body portion between said surface and said opening is greater than about 3/16 inch.

8. The heater of claim 1 wherein said thick body portion is located upstream of body extent in which flowing water is heated by said means.

9. The heater of claim 1 including a pool or spa having water flow ducting connected with said heater inlet and outlet openings.

* * * * *